United States Patent [19]

Schirrmeister et al.

[11] 4,106,767

[45] Aug. 15, 1978

[54] CONVEYOR SYSTEM FOR FLAT ARTICLES

[75] Inventors: Harry Schirrmeister, Munich; Gerd von Aschwege, Groebenzell; Harald Helmrich, Munich; Herbert Bernardi, Arget, all Germany

[73] Assignee: G.A.O. Gesellschaft für Automation und Organisation mbH, Germany

[21] Appl. No.: 749,665

[22] Filed: Dec. 13, 1976

[30] Foreign Application Priority Data

Dec. 12, 1975 [AT] Austria ..... 9436/75

[51] Int. Cl.[2] ..... B65H 29/70; B65H 29/12

[52] U.S. Cl. ..... 271/188; 198/606; 198/817; 271/198; 271/272

[58] Field of Search ..... 271/188, 272, 273, 274, 271/198, 275, 202, 69; 198/606, 817

[56] References Cited

U.S. PATENT DOCUMENTS

| | | | |
|---|---|---|---|
| 2,719,714 | 10/1955 | Pratt et al. | 271/272 |
| 3,279,587 | 10/1966 | Gray et al. | 198/817 X |
| 3,340,618 | 9/1967 | Bentzman | 271/272 X |
| 3,545,371 | 12/1970 | Reist | 271/272 X |
| 3,595,565 | 7/1971 | Bergland | 271/188 X |
| 3,800,432 | 4/1974 | Miyata et al. | 271/195 X |

*Primary Examiner*—Bruce H. Stoner, Jr.
*Attorney, Agent, or Firm*—McGlew and Tuttle

[57] ABSTRACT

This disclosure is directed to a conveying system for transporting documents from the delivery end of one conveyor section to the spaced apart entry end of a receiving conveyor section in a manner wherein the document is stiffened by imparting undulating or corrugated folds therein as it is conveyed so as to facilitate the transfer of the document from one conveyor to the next and thereby permitting at least one or both sides of the document to be checked or read as it is being conveyed from one station to the next at the point of transfer.

4 Claims, 7 Drawing Figures

CONVEYOR SYSTEM FOR FLAT ARTICLES

The present invention relates to a conveyor system for flat articles, such as bank notes, documents, and the like, wherein the articles to be conveyed, especially at high conveying rates, are clamped and thus guided between belts or bands and yet are rendered freely accessible in spots over as large an area as possible for checking purposes.

PROBLEM

To ensure the free accessibility, the conveying track would therefore have to be interrupted, which, of course, would entail uncertainties in the guiding of the articles to be conveyed. In order not to interrupt the continuous process, it would also be possible in principle to form adjacent conveying sections which would have to be so far apart that the checking stations could be effective. It is, however, easy to see that this would create an uncontrolled free-flight path which, in addition, would not ensure that the articles coming from the delivery system are properly introduced into the receiving system.

PRIOR ART

Attempts have therefore been made to avoid these free-flight paths, and the problem has been solved differently by arranging several checking stations in a row to cover the whole surface of the paper. To do this, the conveyor belts are staggered in parts, so that during the checking operation different portions of the paper surface will be alternately covered up and exposed by the conveyor belts, which, in spite of there being no interruption in the guiding of the articles to be conveyed, allows the articles to be checked by optical means over their entire area and on both sides.

The special disadvantage of such checking sections lies in their dependence on the size and the typography of the articles to be conveyed, because such conveyor systems can always be optimized for one size only. If there are changes in the height or the typography of the articles to be conveyed, compromises must, as a rule, be made which may in many cases adversely affect the validity of the results of the check.

From German Offenlegungsschrift (DT-OS No. 2,508,591) Published Sept. 11, 1975 it is also known to provide, in modular conveyor systems at the interfaces of the individual sections overlapping passages which ensure the transfer of the articles to be conveyed. Since one side of each belt or band arrangement reaches from one section to the other, the sections are interlocked and thus are difficult to separate from each other.

The invention therefore follows a different approach and proposes a conveyor system with a free-flight section because the latter offers the best possibility of performing checks at the surface of the articles to be conveyed.

The object of the invention is, therefore, to provide a conveyor system for flat articles, such as bank notes, documents, and the like, wherein the articles to be conveyed are guided between belts, bands or the like, and which has several conveying sections spaced so far apart that free access to the surface of the articles to be conveyed is possible for checking purposes.

SUMMARY OF THE INVENTION

The invention is characterized in that at least the two drive rollers forming the delivery end of a conveying section have meshing protuberances which are concentric with the axis of rotation, project beyond the surfaces of the rollers, and cause a reversible, wave-like deformation of the articles perpendicular to the direction of transport.

Advantageously, the protuberances can be formed by the conveyor belts or bands themselves. It is also possible, however, to provide concentric, elastic rings on the rollers.

A particular advantage is that, through the arrangement according to the invention, the whole surface of the article to be conveyed can be checked on both sides at a fraction of the cost involved heretofore. In addition, the invention permits a considerably simpler modular construction because all modules can be constructed and mounted separately from each other. Any interlocking of the modules by overlapping transfer facilities is no longer necessary.

If, in special applications, advantage is to be taken only of the fact that the modules form independent, isolated units, it is advisable, particularly in the case of installations where documents are moved at low speeds, to bridge the separations between conveying systems by means of additional belt joints.

In that case, the modules are no longer easy to separate from each other, so the cost of assembling or disassembling the conveyor system transfers is slightly higher. On the other hand, the advantages of the special arrangement lie in the fact that the individual modules continue to form independent units and thus can be constructed independently of each other and operated separately from each other for testing purposes or the like. Another advantage is that at low speeds, reliable transfer of the components from module to module is now ensured.

BRIEF DESCRIPTION OF THE DRAWINGS

The invention will now be explained in more detail with reference to the accompanying drawings, showing, by way of example, a few embodiments of the invention, and wherein:

FIG. 1 shows a top view of the separation 17 between two conveying sections or modules 1, 2 with a free-flight path. The document delivered by the conveyor system of the section 1 from the direction of the arrow 12 is clamped between the conveyor belts 3, 4 and reaches the roller pair 8, 9, leaves section 1, and moves into the conveyor system of the adjacent section 2. To ensure that the leading edge of the paper, having passed the roller pair 8, 9, reaches the roller pair 10, 11 without folding away toward the side, the shape of the roller pair 8, 9 according to the invention impresses on the paper a temporary wave or corrugated profile which considerably increases the paper's longitudinal stiffness. Thus reinforced, the paper can bridge the separation 17 without additional mechanical guidance and is received by the entry side roller pair 10, 11 of the section 2. To prevent the document 7 from being crushed upon reaching the roller pair 10, 11, the latter has the same protuberances as the roller pair 8, 9.

Figure 1:
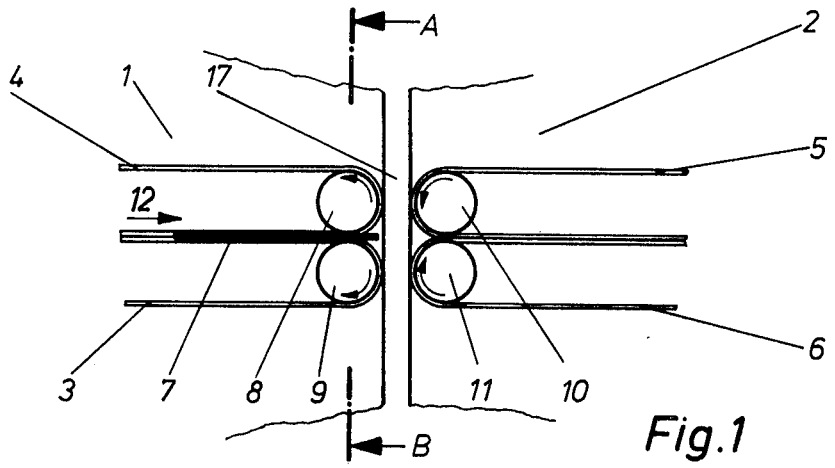
FIG. 1 is a top view of a separation between two conveying sections with a free-flight path.

Since the special design of the roller pairs 8, 9 and 10, 11 allows the documents to be transported over short distances without mechanical guidance, it is possible, as shown in FIG. 1, to make the conveying sections flush with the outside edges of the sections. This is particularly advantageous in that the individual sections can be combined and shifted relative to each other at will for servicing purposes or the like.

Figure 2:
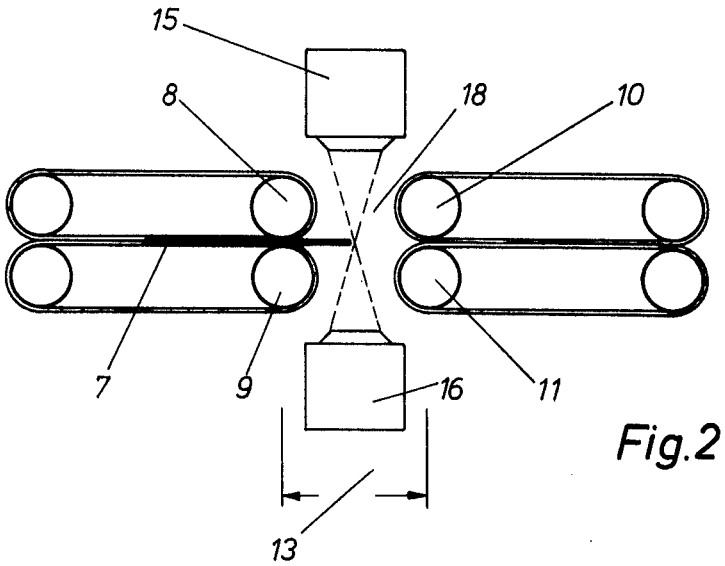
FIG. 2 is a top view of a separation with a free-flight path and an optical surface-checking station.

FIg. 2 shows another application. In this embodiment, which comprises an optical checking station, the delivery roller pair 8, 9 and the entry side roller pair 10, 11 are so far apart that the optical sensors 15, 16 have a sufficient field of view for checking the surfaces of the papers moving past. Depending on the length and strength of the paper, the distance between these two roller pairs can be varied within wide ranges and thus adapted to requirements.

Figure 3:
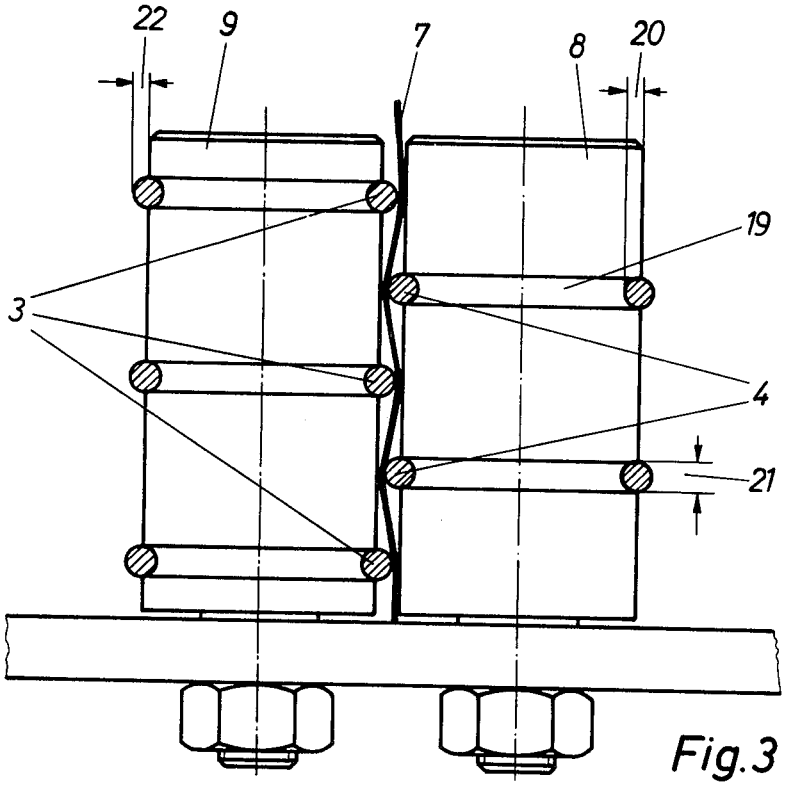
FIG. 3 shows the pair of delivery rollers of the delivery conveyor section according to the invention.

FIG. 3 shows one possibility of forming the protuberances of the rollers 8, 9. This is achieved by causing the conveyor belts 3, 4 to project beyond the surfaces of the rollers 8, 9. It can also be seen that the conveyor belts of the roller 8 are staggered with respect to the conveyor belts of the roller 9 so as to be in engagement. This results in the illustrated deformation of the paper 7 during transport. The height 22 of the protuberances, which is dependent on the groove depth 20 and on the belt thickness 21, determines the deformation and, thus, the longitudinal stiffness of the paper. By varying these values, adaptation to the respective type of paper can be achieved as required.

Figure 4:
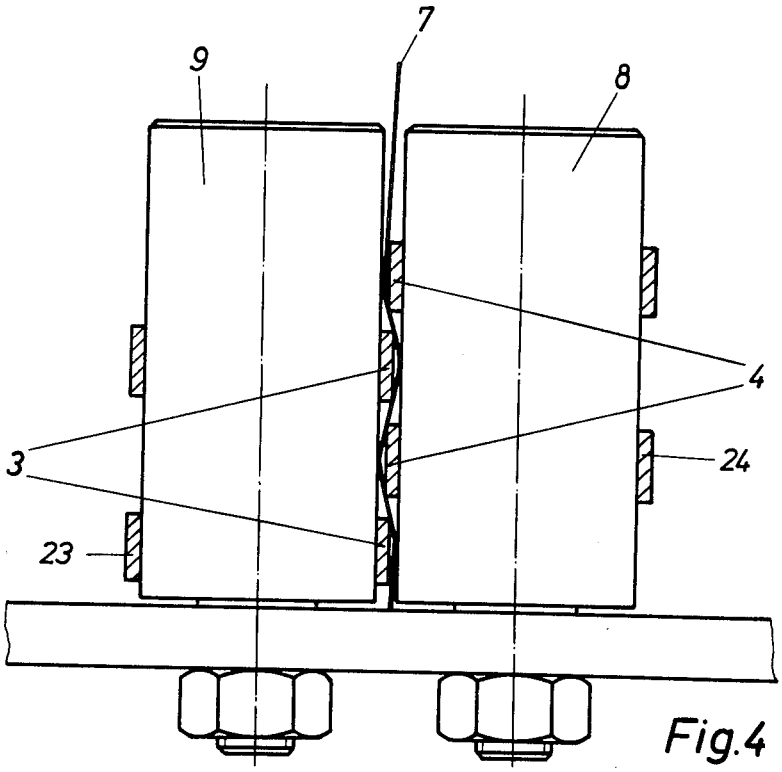
FIG. 4 shows another embodiment of the invention in a band conveyor system.

The example shown in FIG. 4 uses conveyor bands 23, 24. In the absence of grooves 19, the drive rollers can be simpler in design. By adjusting the distance between the rollers and changing the bands, adaptation to other types of paper, e.g. from normal paper to tissue paper, is relatively easy.

Figure 5:
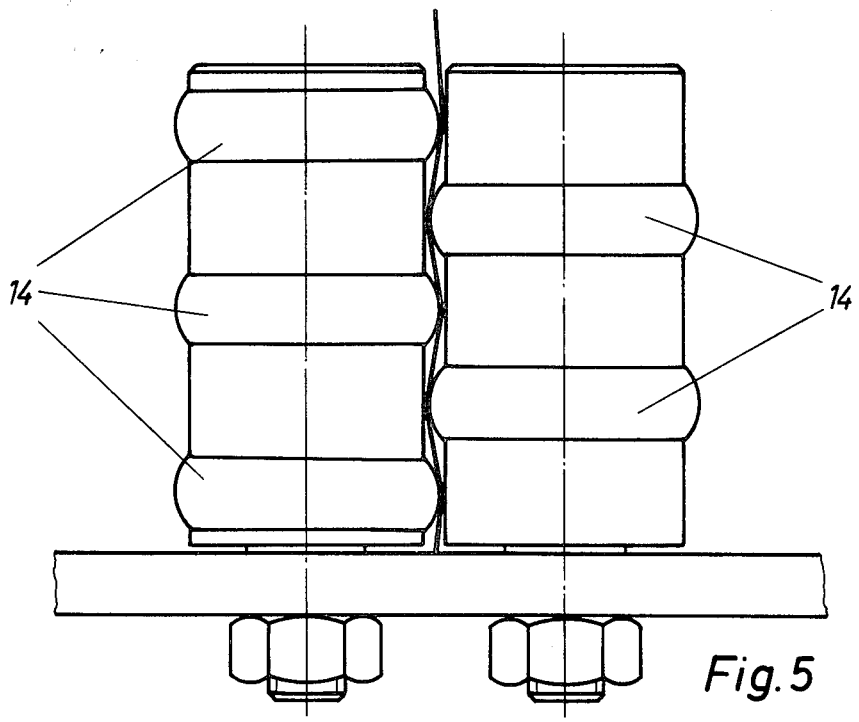
FIG. 5 shows the pair of drive rollers with elastic rings according to the invention.

To meet the requirements according to the invention, it would be sufficient to provide only the delivery and entry-side roller pairs of the individual conveying sections with the special profile. To simplify stock-keeping, and since the provision of the remaining drive rollers with the features according to the invention entails no disadvantages whatsoever, it is also possible to provide all drive rollers with the features according to the invention. Through the now permanent stiffening of the paper, transfer from belt conveyor systems to roller conveyor systems is possible without the disadvantages of the known systems. To accomplish this, the drive rollers are equipped with rubber protuberances 14, as shown in FIG. 5.

Figure 7:
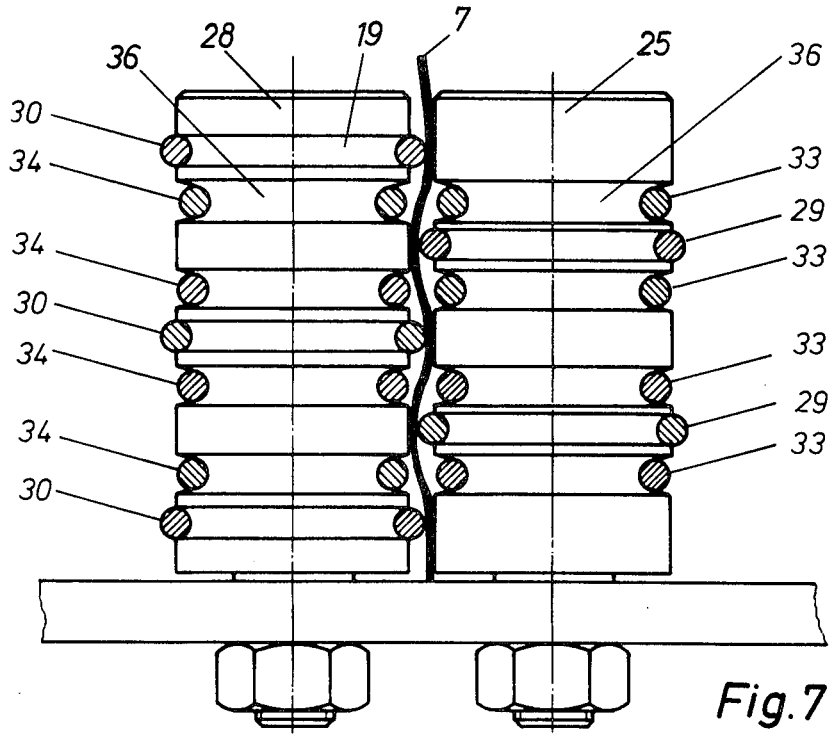
FIG. 7 is a section through the pair of rollers taken along the line C-D of FIG. 6.
Figure 6:
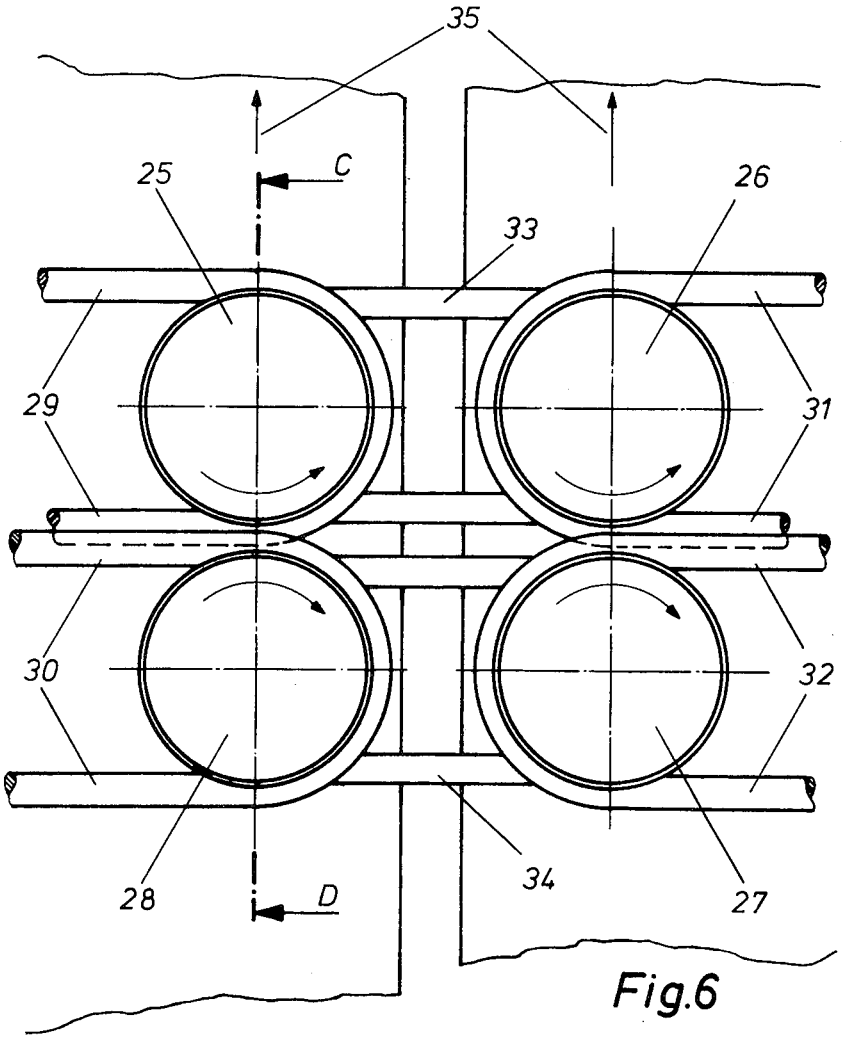
FIG. 6 is a top view of an improved separation between two conveying sections.

FIGS. 6 and 7 show an embodiment of a transfer between conveying systems by means of which documents supplied at low speed and possibly deflected from the normal direction of transport are reliably guided from one module or section to another.

FIG. 6 is a top view of a separation between two sections, and FIG. 7 a section through a roller pair as shown in FIG. 6.

As in FIGS. 1 and 3, the rollers 25, 28 and 26-27 carry in their grooves 36 staggered conveyor belts 29, 30 and 31, 32, whose function was explained above. In addition to the conveyor belts, there are now provided guide belts 33, 34 which link the drive rollers 25, 28 and 26, 27, respectively, to bridge the separation (FIG. 6). The arrangement of the guide belts 33, 34, four of which are arranged in pairs, side by side and distributed over the whole width of the rollers, is shown in FIG. 7. It can also be seen that, unlike the conveyor belts, the guide belts of the rollers 25, 28 and 26, 27 are so deeply embedded in special grooves 36 as to be flush with the surfaces of the rollers. The guide belts are located in the gaps formed by the arrangement of the conveyor belts 29, 30, and lie opposite each other a certain distance apart.

As mentioned, it is advantageous to use, in an arrangement consisting of several sections, like drive rollers which then provide the documents with an invariable profile. Through the special arrangement of the guide belts, which, forming a gap, do not touch documents being transported in proper manner, the document profile achieved thus remains unchanged. Only the movement of a document which may have been deflected from the direction of transport at low speeds is corrected by means of the guide belts.

Finally it should be mentioned that the rollers 25 and 26, which are firmly mounted in operation, can be shifted perpendicular to the direction of transport, as indicated by the arrow 35 in FIG. 6, to permit easy handling of the belts during maintenance work.

What is claimed is:

1. A conveying system for conveying documents comprising a first conveyor section and a second conveyor section, each of said sections including a pair of endless conveyors, said conveyors respectively being disposed in side by side relationship and having corresponding flight portions contiguously disposed so that a document is conveyed by said contiguous flight portions as said conveyors are driven, said conveyors of said first section having end rollers defining a delivery end, and said conveyors of said second section having end rollers defining an entry end, said delivery end being spaced from said entry end, and said conveyors including a series of belts threaded about the end rollers defining said delivery end and entry end respectively, said belts being threaded about their respective end rollers to project beyond the circumference of its respective end rollers, whereby said belts extending in said contiguous flight portions of said pair of endless conveyors are staggered to impress upon a document conveyed therebetween an undulating cross-section shape, and including guide belts, said guide belts being threaded about the end rollers defining said delivery end and said entry end of said sections respectively whereby said guide belts extend across the space between said sections.

2. A conveying system as defined in claim 1, wherein said guide belts are spaced from each other by a distance such that any deviation from the normal direction of conveyance of said document is corrected.

3. A conveying system as defined in claim 1, wherein said end rollers are provided with grooves and said guide belts are disposed in said grooves so as to be flush with the surface of said end rollers.

4. A conveying system as defined in claim 3, wherein said guide belts are disposed in pairs opposite to each other about said end rollers.

* * * * *